United States Patent [19]

Johnsen

[11] 4,012,268

[45] Mar. 15, 1977

[54] CONTINUOUS BUSINESS FORM OR THE LIKE ADAPTED FOR SUBSEQUENT PROCESSING INTO ORIGINAL INDICIA BEARING LOTTERY TICKETS, ENVELOPES OR THE LIKE

[76] Inventor: Edward L. Johnsen, 12 Fox Meadow Lane, Wayland, Mass. 01778

[22] Filed: Nov. 17, 1975

[21] Appl. No.: 632,231

Related U.S. Application Data

[62] Division of Ser. No. 433,463, Jan. 15, 1974, abandoned.

[52] U.S. Cl. ..... 156/200; 156/204; 156/277; 156/291; 229/69; 270/61 A

[51] Int. Cl.[2] ..... B31F 1/00

[58] Field of Search ..... 156/199, 200, 204, 290, 156/291, 227, 277, 384, 461, 459, 320; 283/6, 1 B; 282/11.5 A; 229/69, 73; 270/61 A

[56] References Cited

UNITED STATES PATENTS

| | | | |
|---|---|---|---|
| 2,377,348 | 6/1945 | Lee | 283/62 |
| 2,557,723 | 6/1951 | Brenn | 156/320X |
| 3,497,242 | 2/1970 | Seidman | 283/6 |
| 3,899,381 | 8/1975 | O'Brien | 156/204 |

*Primary Examiner*—David A. Simmons
*Attorney, Agent, or Firm*—J. Warren Kinney, Jr.

[57] ABSTRACT

A continuous business form define a series of connected blanks adapted to be subsequently processed into multi-ply lottery tickets, envelopes or like articles, wherein each blank is developed from a plurality of contiguous longitudinal panels which collectively span the width of each blank, wherein at least one edge adjacent panel of each blank defines a cover panel including means for exposing a portion of another panel when disposed in direct overlying relationship therewith, and wherein one surface of certain of the contiguous panels is provided with an adhesive which is not activated for adhering to other panels of the blank until after original indicia has been applied to at least one panel other than said cover panel. Thereafter, the cover panel is continuously folded and permanently bonded into direct overlying relationship with an indicia bearing panel such that only a portion of the indicia is concealed, producing the continuous series of multi-ply articles wherein each article contains both exposed and concealed original, directly applied indicia.

11 Claims, 25 Drawing Figures

FIG-4
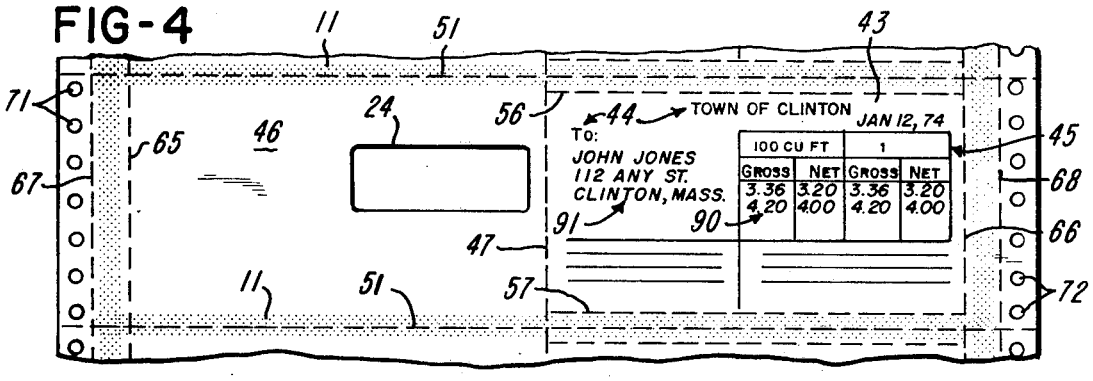
FIG-5
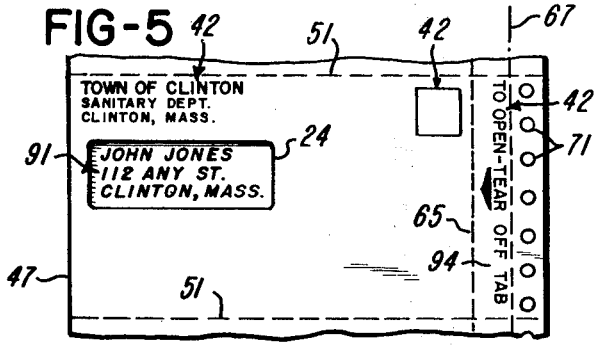
FIG-6
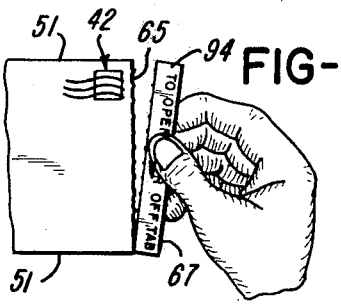
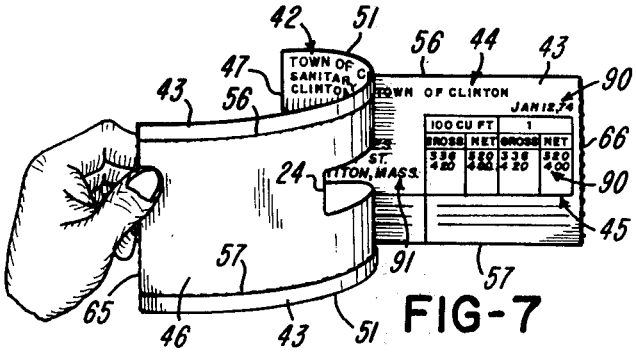
FIG-7
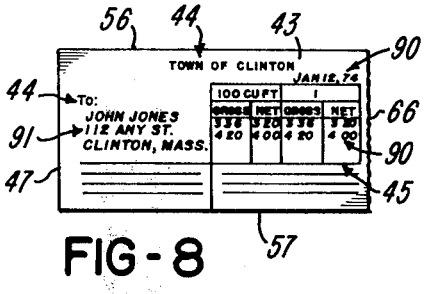
FIG-8

WINNING NUMBER
WINNING NUMBER
WINNING NUMBER
WINNING NUMBER

WINNING NUMBER
THE INSTANT GAME

THE INSTANT GAME
THE INSTANT GAME
THE INSTANT GAME

THE INSTANT GAME
THE INSTANT GAME

FIG-19
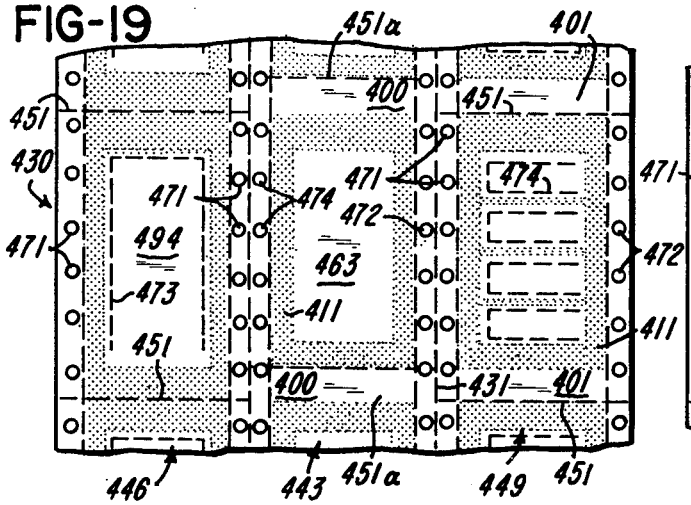
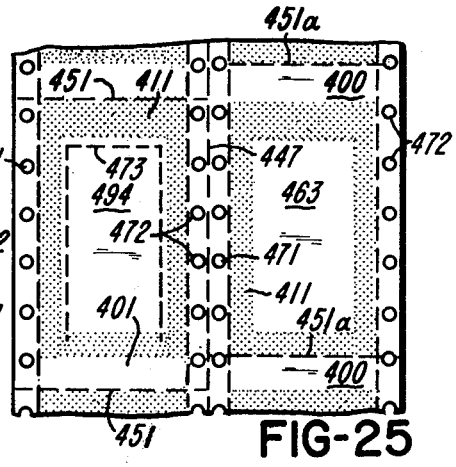
FIG-25
FIG-20
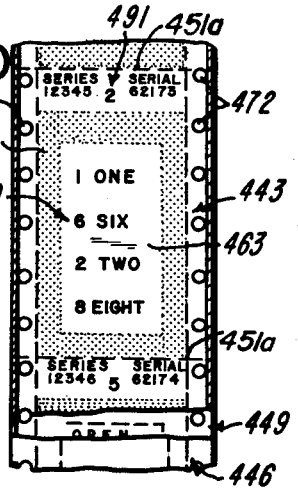
FIG-21
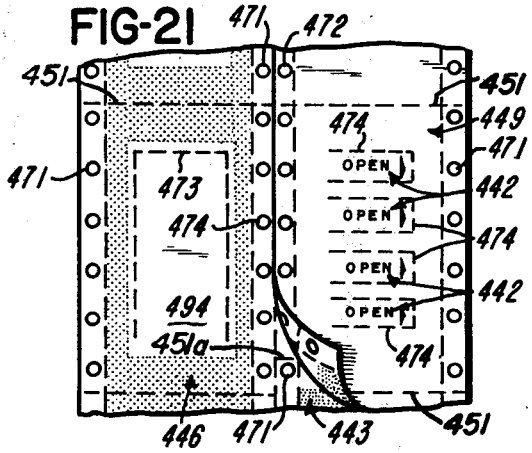
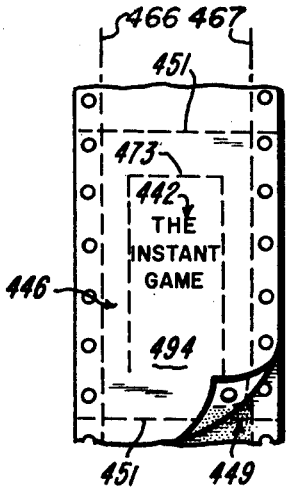
FIG-22
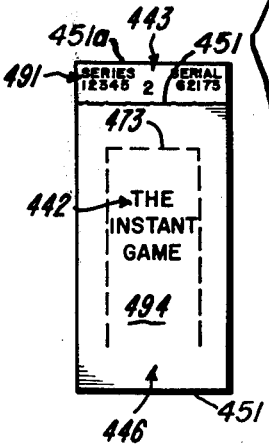
FIG-23
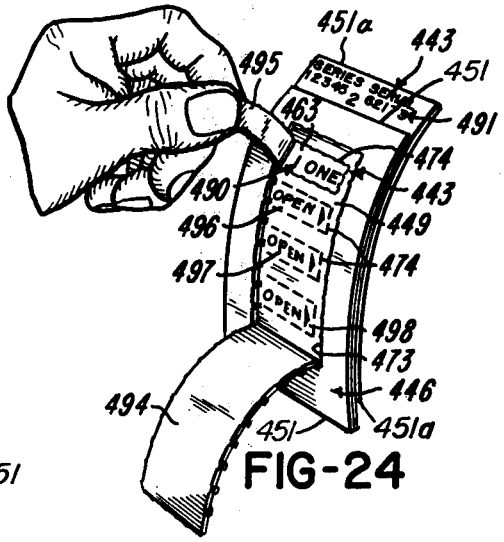
FIG-24

CONTINUOUS BUSINESS FORM OR THE LIKE ADAPTED FOR SUBSEQUENT PROCESSING INTO ORIGINAL INDICIA BEARING LOTTERY TICKETS, ENVELOPES OR THE LIKE

CROSS REFERENCE TO RELATED APPLICATIONS

This is a division, of application Ser. No. 433,463, filed Jan. 15, 1974 now abandoned.

Each of my co-pending applications Ser. Nos. 433,461, now U.S. Pat. No. 3,940,124, 433,464, now U.S. Pat. No. 3,596,049, 433,462, now abandoned, and 633,490, now U.S. Pat. No. 3,981,435 filed on date herewith each specifically discloses a particular genus of continuous business forms, the resulting articles and corresponding methods of manufacture.

The first mentioned application discloses a form wherein original indicia may be applied directly to separate surfaces of a cover ply and under ply of an article formed from a continuous web having at least three longitudinally extending co-planar panels, comprising a cover ply panel and an under ply panel separated by an intermediate, discardible panel, wherein one of the ply panels is disposed in overlying relationship with the discardible panel, thereby placing separate surfaces of the ply panels in side-by-side juxtaposition for application of indicia.

Application Ser. No 433,461 discloses a form wherein original indicia may be applied directly to common surfaces of cover ply and under ply panels of a continuous series of articles, but replaces the continuous fold and the discardible panel of Ser. No. 433,464 with an accordion fold, placing the various plies in zig-zag relationship.

Application Ser. No. 433,462 utilizes the teachings of either the present application or those of Ser. No. 433,464 in combination with a method for collating a plurality of continuous webs into registered overlying relationship for producing a series of stuffed, sealed envelopes or the like, including in some instances an attached return envelope form.

Further, my co-pending application, Ser. No 266,415 filed Feb. 15, 1972, now U.S. Pat. No. 3,837,565 discloses an envelope form produced from a continuous web and in some instances, see particularly FIGS. 1 and 4, includes and under ply bearing original indicia on one surface thereof and a cover ply panel including a window disposed in direct overlying relationship therewith, concealing selected portions and exposing selected portions of the original indicia. That application varies from the present application in that the method for applying the indicia is neither disclosed nor suggested. As is clearly illustrated in the other drawings of Ser. No. 226,415, each envelope is adapted to be printed after separation from the continuous series of envelopes and is particularly suited for use where record copies are required, see FIGS. 7–27. Ser. No. 226,415 is not specifically directed to application of original indicia and preservation of the confidential nature thereof.

My co-pending application, Ser. No. 382,162, filed July 24, 1973, now U.S. Pat. No. 3,945,870 discloses an embodiment, see particularly FIGS. 4-8, which in final form has an appearance similar to the embodiment of FIGS. 15-18 of the present invention. Ser. No. 383,162 is not, however, related to the problem of providing both concealed and exposed original indicia and the method there disclosed neither suggests nor discloses a suitable solution, but is directed to the use of a web of release material collated with an endless web of series-connected articles that utilize a pressure sensitive bonding adhesive.

BACKGROUND OF THE INVENTION

1. Field of the Invention

The field of the invention relates generally to business forms, particularly to a continuous form which comprises a series of connected blanks suited for subsequent processing into multiply lottery tickets, envelopes or like articles which contain original, directly applied concealed indicia on an under ply. As used herein, the term "original indicia" excludes preprinted indicia and indicia applied by transfer means such as carbon paper, and the like. Each blank comprises an article such as a lottery ticket, envelope or the like having at least two plies disposed in direct overlying relationship, the over ply partially exposing and partially concealing the under ply, wherein a portion of the over ply is permanently bonded to a portion of the under ply, forming a closed pocket therebetween, and wherein original directly applied indicia is contained in the pocket, concealed by the over ply, the concealed indicia being exposable through access to said closed pocket.

2. Description of the Prior Art

A number of patents have issued disclosing a variety of articles of multi-ply construction having an interior exposable pocket containing concealed indicia such as with lottery tickets, envelopes or the like. Certain of these patents disclose articles wherein a portion of the under ply is permanently exposed by means provided in the over ply, the remainder of the under ply being concealed by the overply.

U.S. Pat. Nos. 3,411,699 and 3,482,780 are exemplary of the prior art when considering the present invention. My earlier patent, No 3,482,780 discloses an envelope assembly wherein each envelope includes front and back panels joined at and including a common margin. The front panel includes a window for exposing a portion of the back panel when the envelope is closed, wherein the back panel is adapted to receive original indicia which is partly concealed and partly exposed by the front panel. While the envelope of U.S. Pat. No. 3,482,780 resembles the envelope of the present invention in final form, the envelope disclosed therein does not permit of continuous final assembly, required for high-speed printing and mass assembly techniques. The envelope therein disclosed is generated from a single, continuous web which is subdivided by lateral scorelines into interconnected transversely spaced blanks, each blank defining one envelope form. Spaced intermediate each pair of spaced lateral scorelines is a lateral foldline, separating each blank into a pair of panels, viz a front and back panel. Each envelope form is printed in this assembly and then separated therefrom prior to folding and sealing.

U.S. Pat. No. 3,411,699 discloses a pre-stuffed, presealed series of connected envelope forms wherein the over ply of each envelope contains a window therein for exposing a portion of an intermediate insert ply. The intermediate insert ply may be preprinted with indicia prior to assembly or transfer printed after assembly. The pertinent continuous form of U.S. Pat. No. 3,411,699 is made from at least three continuous webs collated in direct, overlying relationship with each other wherein a first web forms the back panel of the envelope, a second web forms a removable insert, and a third web forms the top ply and includes a window for exposing a portion of the insert. This envelope assembly does not permit nor even suggest the printing of an under ply with original indicia while said under ply is an integral part of the envelope assembly, and is not producible from a single, continuous web by folding along a continuous longitudinal foldline.

Further, no prior art found, including the above patents, discloses articles suitable for use as window bearing lottery tickets or the like wherein the concealed portion of the under ply contains original, directly applied indicia which is inaccessible without first removing a portion of at least one ply of the article.

SUMMARY OF THE INVENTION

The present invention is directed to a method of producing a series of connected blanks which are particularly suited for subsequent processing into multi-ply lottery tickets, envelopes or like articles; to the blanks per se; and to articles formed therefrom.

A continuous series of blanks are fabricated from an endless web of sheet material wherein the web is defined by a plurality of longitudinal, contiguous panels. Each blank defines a multi-ply article such as a lottery ticket, envelope or the like, wherein one panel of the web forms the under ply of the article and is adapted to receive original, directly applied indicia, and at least one other panel or the web forms a cover ply which includes means for exposing a portion of the under ply when disposed in direct overlying relationship therewith. Adhesive is selectively applied to a portion of a surface of certain of the contiguous panels, after which the individual blanks are suitably accumulated for later use.

When later used, the individual, interconnected blanks are advanced through a computer controlled printer or the like where the indicia is applied to the upper exposed surface of at least one panel other than the cover panel of the web. The web is then continuously longitudinally folded for disposing each cover panel in direct overlying relationship with an indicia bearing panel, concealing a portion thereof and exposing a portion thereof, after which said panels are permanently bonded to one another by means of the adhesive initially applied, thereby completing a series of articles which are then adapted to be severed or otherwise separated from the web in the form of completed lottery tickets, envelopes or like articles.

It is, therefore, an object of the invention to provide a form suitable for subsequent processing into envelopes, lottery tickets or like articles wherein the sealed pocket portion of the final article contains original, directly applied indicia.

It is further an object of the invention to provide a multi-ply article wherein at least a portion of under ply is permanently exposed through means provided in an over ply.

It is further an object of the invention to provide a tamper proof lottery ticket wherein the possibility of premature exposure of the concealed indicia is minimized.

It is yet another object of the invention to provide a method for manufacturing a continuous form adapted to be subsequently processed into the articles here mentioned and to provide the unique configuration of the form so adapted, wherein each article is produced from a continuous single web having at least two contiguous longitudinal panels spanning the width thereof and adapted to be disposed in overlying relationship by continuously folding along a common longitudinal foldline.

It is further an object of the invention to provide a family of articles conforming to the various other objectives of the invention, to wit: a lottery ticket having tamper proof features for use with games of chance, particularly as utilized and required by state lottery systems, or the like, where it is essential that an interior, enclosed pocket surface of the ticket contain original, directly applied indicia; and a mailing envelope which not only contains originally directly applied permanently exposed indicia, but also provides for original directly applied indicia on an interior concealed surface thereof.

Other objects and features of the invention will be readily apparent from the following detailed description.

BRIEF DESCRIPTION OF THE DRAWINGS

FIGS. 4–8 illustrate the various steps for producing a continuous form by the process of FIGS. 1–3 and a mailing envelope obtained therefrom.

FIGS. 19–25 illustrate the various steps for producing a fifth continuous form by the process of FIGS. 1–3 and a lottery ticket obtained therefrom.

DESCRIPTION OF THE PREFERRED EMBODIMENT

Figures 1, 2, 3:
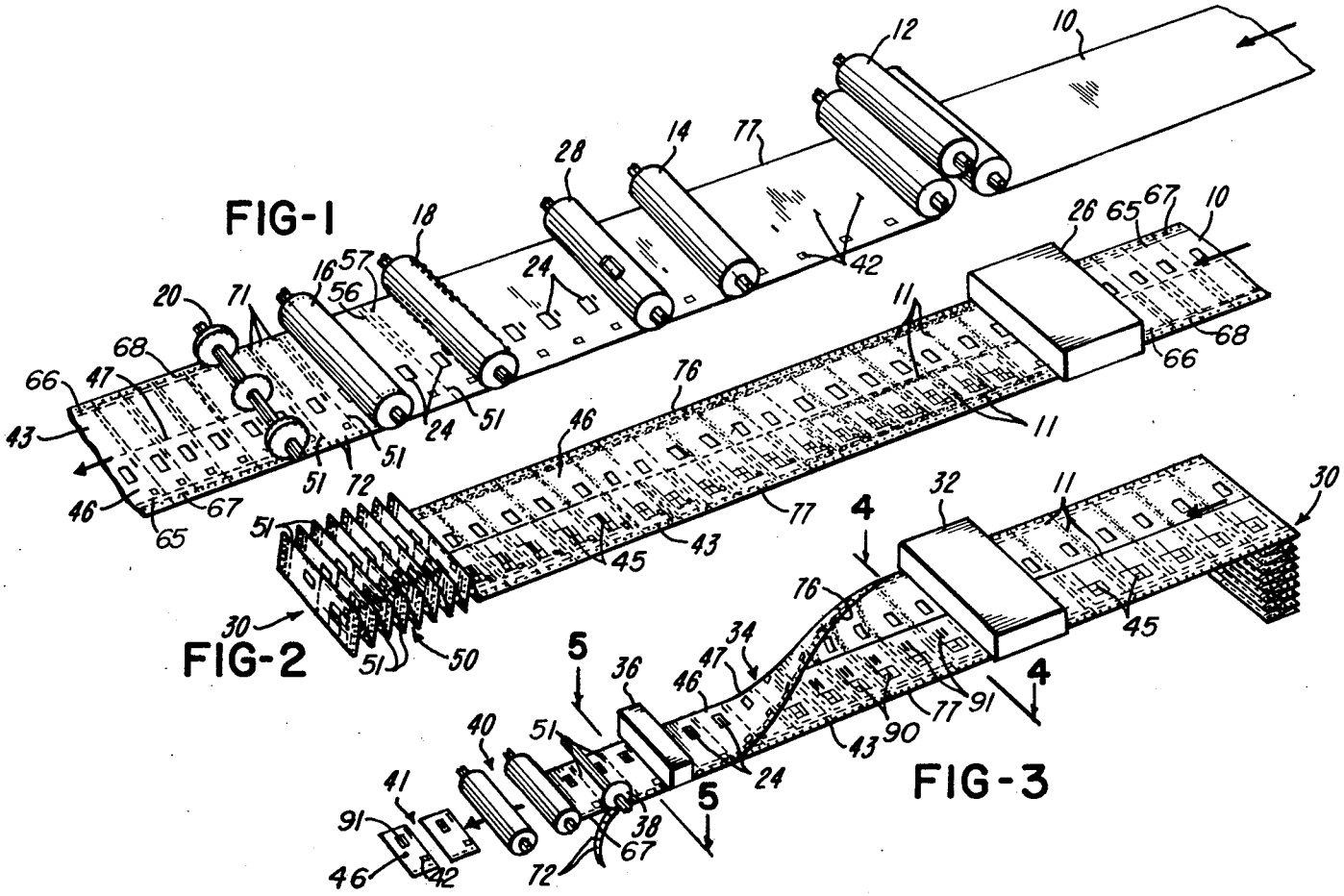
FIGS. 1, 2, and 3 diagrammatically illustrate steps in the method of making the continuous form comprising a series of interconnected blanks, and the articles incorporating features of the present invention.

The continuous form of the present invention defines a series of interconnected blanks uniquely designed to receive indicia on at least one panel thereof and having a cover panel including means for exposing a portion of the indicia bearing panel while concealing the remainder thereof when disposed in direct overlying relationship therewith. The form is designated generally by the reference numeral 30 as illustrated particularly in FIG. 2, and is adapted to be subsequently processed into mailing envelopes, lottery tickets or like articles wherein the final article includes a concealed pocket for carrying concealed indicia. The present form is unique in that it permits application of original, directly applied indicia to the internal surface of the pocket, wherein the under ply is thereafter partially covered by an over ply, concealing the indicia in the pocket portion, and wherein the remainder of the under ply is exposed through means included in the over ply. An adhesive applied to at least one of the contiguous panels bonds the plies to one another and generally surrounds the concealed portion, thereby concealing the indicia in a substantially sealed pocket area. The present form permits the processing of envelopes, lottery tickets or the like in a continuous manufacturing process wherein each article is formed by folding along a single, continuous foldline in the endless web.

The preliminary steps required to properly prepare the endless web 10 are shown generally in FIG. 1 and vary depending upon the configuration of the final article. Generally, certain identifying and instructional indicia is applied on either or both sides of the web at printer 12. Inventory control data may be added at station 14, and may include, for example, run number, date, form style number, or similar information. This control data is generally added to a discardable portion of the form and is deleted from the final article. It is often desirable to add one or more continuous series of line holes 71 and 72 at punch station 16. The line holes are adapted to be engaged by sprocket gears or the like whereby the finished form is advanced through subsequent processing stages. The form is often but not necessarily separated into independent, interconnected blanks at station 18 by supplying scored or perforated weakened lines 51, each line transversely spinning the width of the web, wherein the individual blanks constitute at least one article. Longitudinal weakened line 47 is supplied at 20 and divides the continuous web into a pair of longitudinal, contiguous panels which collectively span the width of the web.

While each of these steps are preliminary and may be performed in any order, with certain steps added and others deleted depending only upon the configuration of the final article, it should be understood that certain preliminary preparation of the web 10 is generally essential prior to generation of the continuous form 30.

In certain of the disclosed embodiments, window 24 is supplied in one panel at station 28. In other embodiments of the web, the means for exposing a portion of the under ply are otherwise provided, as herein described. The web 10 is advanced through gluing station 26 where a so called initially inactive adhesive 11 is applied to a portion of an upper surface of the web. The form is then folded or otherwise accumulated at station 50 for subsequent processing.

The form 30, as illustrated in FIG. 2, is particularly suited for subsequent processing into envelopes or the like having a concealed pocket containing original directly applied indicia wherein a cover ply 46 is disposed in direct overlying relationship with an indicia bearing ply 43, the cover ply including means, such as window 24, for exposing a portion of the under ply when so disposed. Therefore, subsequent processing steps illustrated in FIG. 3 produce a plurality of final article from the form 30. In general the continuous form 30 is advanced through a controlled printer 32 wherein original indicia 90, 91 (FIGS. 4–8) is directly applied to the surface of a portion of the web, here panel 43. The form is next continuously folded along foldline 47 at station 34, placing marginal edge 76 in registry with marginal edge 77 and disposing panel 46 in direct overlying relationship with panel 43, thereby concealing a portion of panel 43 and exposing a portion thereof through window 24.

The adhesive coating 11 applied at station 26 forms a permanent seal between and permanently bonds portions of panels 43 and 46 to one another to generate a closed pocket containing concealed, originally applied indicia. One example of initially inactive adhesive is hot-melt glue of the type having an affinity for the surface of the web when applied at station 26, quickly becoming "inactive" as that term is used herein until heated by a heat source located at station 36. Glue of this type is applied in an adherent, tacky, liquified state, thereafter transformed to a non-tacky state in which it remains until heated at station 36. It should be understood that other types of adhesive bonding could be utilized without departing from the spirit of the invention. One such example is known as self-stick adhesive, wherein the adhesive once applied will not adhere to anything but another coating of the same adhesive. Utilization of this adhesive would require replacement of the heat source at 36 with a nip-roll for applying pressure to the adhesive contact areas. It should be understood that for purposes of the present disclosure and claims an adhesive of the self-stick type is considered initially inactive, and is said to be activated when placed in direct contact with another surface having the same adhesive coating.

After sealing the printed form, the access and marginal regions, including line holes 71, 72, may be removed along lines 67, 68 at station 38 and the form may be separated into individual articles at 40 for distribution at 41.

Thus, the basic continuous form 30 is generated by the steps illustrated in FIGS. 1 and 2 from a continuous web of material properly prepared as illustrated by steps in FIG. 1. It should be understood that some of the preliminary steps illustrated in FIG. 1 could be performed subsequent to glue applicating station 26 if desired. The steps subsequent to generation of the continuous form 30 are illustrated in FIG. 3, and are utilized to produce a final article from the form of FIG. 2.

Therefore, FIGS. 1, 2, and 3 illustrate steps in the method of making the continuous form, the continuous form per se, and in general a final article meeting the objectives of the present invention. By utilizing a web having at least two contiguous longitudinal panels, here panels 43 and 46, wherein one panel defines the under ply of an article and another panel defines the cover therefor, it is possible to provide a final multi-ply article having a concealed pocket containing original, directly applied indicia wherein a portion of the under ply is exposed through means provided in the over ply and wherein the final multi-ply article is generated by continuously folding the web along a common foldline between the panels.

FIGS. 4–25 illustrate various embodiments derived from the steps of the method taught in FIGS. 1–3. While each of the embodiments vary with respect to detail, the principle is identical, i.e., achieving a final article having a concealed pocket containing directly applied original indicia wherein a portion of the article under ply is exposed through means provided in the cover or over ply and wherein the article is generated by continuously folding an endless web along a common boundary between the panels defining the under ply and over ply of the article.

A first embodiment of the continuous form 30, produced by utilizing the particular preliminary steps illustrated in FIG. 1, and the resulting article obtained therefrom is illustrated in FIGS. 4–8. While the embodiment therein disclosed includes independent blanks each defining a single article, it should be understood this is merely illustrative and intended to be neither restrictive nor limiting. The number of articles contained in each blank is limited only by the desired size of the final article.

The form 30, as produced by the process of FIGS. 1 and 2, and after application of indicia at printer 32, is illustrated in FIG. 4, taken at line 4—4 of FIG. 3. The form is separated into two side-by-side panels 43 and 46 bounded by a longitudinal foldline 47. Foldline 47 as well as tear lines 65, 66, 67, and 68 are provided at station 20, wherein lines 65 and 66 generate a tear strip in the final article to provide access to the envelope pocket.

While not necessary, it is desirable to define the independent blanks of the continuous form in a preliminary step, wherein each blank constitutes at least one complete article. This is provided at station 18 of FIG. 1 by supplying transverse lines 51, as shown in FIG. 4. Again, it is advantageous to also supply transverse weakened lines 56 and 57 at this time. These lines provide access to the pocket of the envelope when fully assembled, as herein described.

The printed indicia 42 on the underside of web 10, see FIG. 5, may include a return address, a postage permit, and instructional material. This as well as indicia 44 and 45 on the upper surface of the web, see FIG. 4, may be applied at printing station 12. The sprocket or line holes 71 and 72 are added at 16. The web is then advanced through step 28, supplying window 24.

The particular glue pattern of the present embodiment is illustrated in FIG. 4 and is applied in a manner similiar to that used to print inked indicia, permitting complex patterns to be generated while maintaining close tolerances. Thus, it is possible to substantially surround the periphery of an envelope pocket with adhesive, forming a seal between plies, thereby encasing the concealed indicia. Where self-stick adhesive is utilized, the glue pattern on panel 46 must match the pattern on panel 43 in order to be effective. However, when hot-melt glue is used the pattern may be varying, applied in the most effective manner, and in fact need only be applied to either of panels 43 or 46. As can be seen, it is only necessary to apply glue 11 to the upper surface of the web. After application of the so-called initially non-adherent adhesive 11, the form 30 is next accumulated at station 50 as shown in FIG. 2, and may be accordion folded, rolled or otherwise accumulated in an endless series of connected blanks. The form is then adapted to be printed, sealed and separated into individual articles for distribution as illustrated in FIG. 3.

The form 30 is advanced through a computer controlled or other printer at station 32 where original indicia, for example addressee 91 and invoice information 90 pertinent to the addressee, is supplied to panel 43, as illustrated in FIG. 4. Sprocket or line hole 71 and 72 are useful in properly advancing the form through the printer. After application of original indicia 90 and 91, the form is continuously folded along line 47 at station 34, thereby placing panel 46 in direct overlying relationship with panel 43 and concealing indicia 90, while addressee 91 remains exposed through window 24. Glue 11 is activated at station 36 by heating or other suitable means to seal the concealed indicia in a closed pocket, as illustrated in FIG. 5. The form 30 is next longitudinally cut or slit at station 38 along line 67 to remove sprocket holes 71 and 72 and other excess marginal material.

The final article is of two-ply construction having panel 46 defining a cover ply partially concealing and partially exposing under ply 43, wherein that portion of the under ply covered by panel 43 contains concealed, directly applied original indicia.

The continuous series of envelopes is adapted to be burst apart at boundary lines 51, 51 to provide individual envelopes. A typical completed envelope, prior to removal of sprocket holes 71 and 72, is illustrated in FIG. 5 taken at line 5—5 of FIG. 3. Tear strip 94, see particularly FIG. 6, is provided inward of glue strip 11 by tear lines 65 and 66. Removal of tear strip 94 permits access to the envelope pocket making it possible to expose the concealed portion of the under ply containing concealed indicia 90, by tearing under ply 43 from the envelope assembly along lines 56 and 57, also spaced inward of glue band 11, as illustrated in FIG. 7. Panel 43 is hinged to front panel 46 of the completed envelope at longitudinal foldline 47 and may be removed as illustrated in FIG. 8.

Thus, a first embodiment of the invention as illustrated in FIGS. 4–8 provides an envelope form for mailing an invoice or similar data which is computer printed at station 32 with original subsequently concealed indicia. By utilizing window 24, the addressee and the invoice information may be printed on a single panel, here panel 43, ensuring accuracy of information and efficiency in handling.

Figure 9:
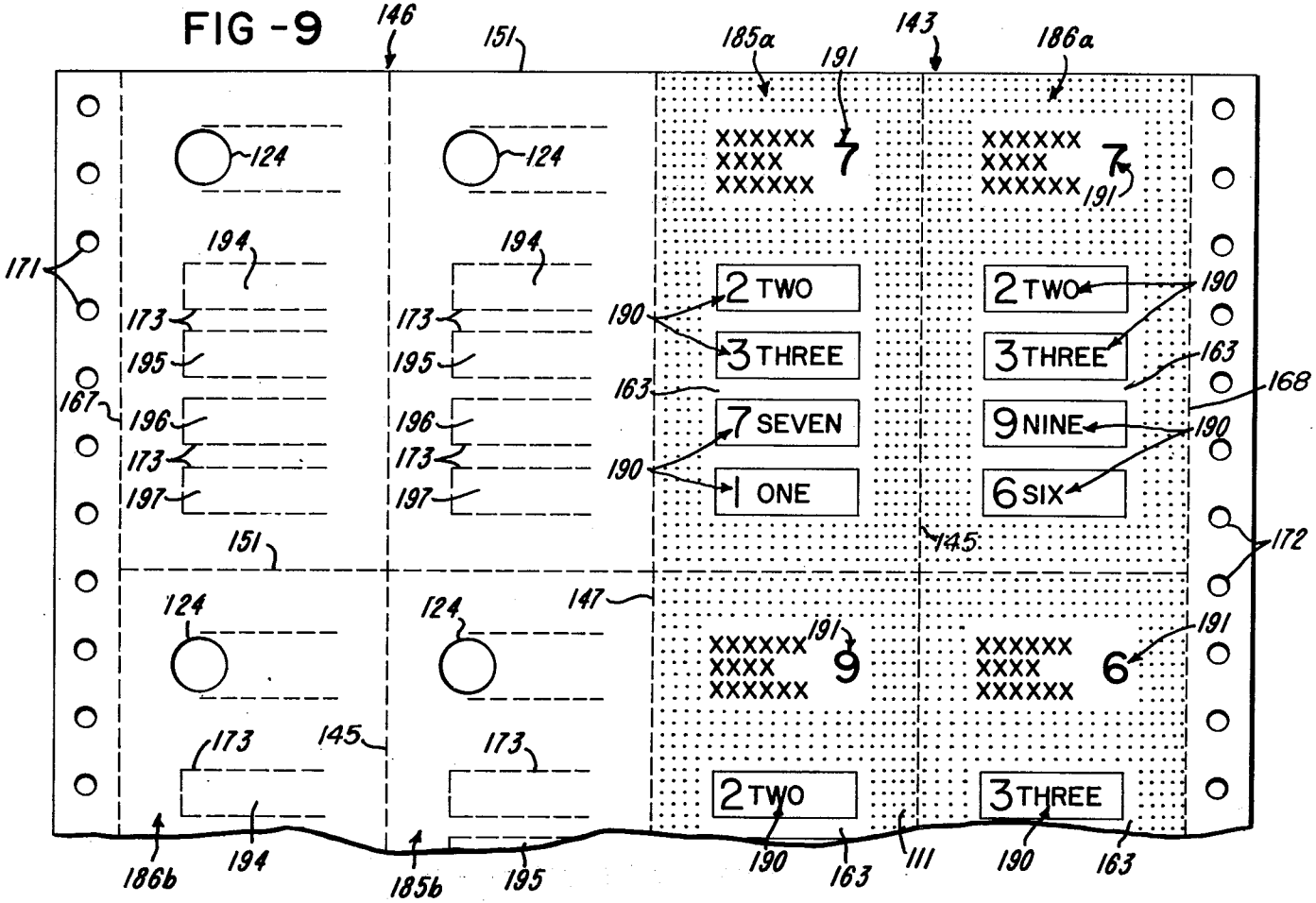
FIGS. 9–11 illustrate the various steps for producing a second continuous form by the process of FIGS. 1–3 and a lottery ticket obtained therefrom.
Figures 10, 11, 13, 14:
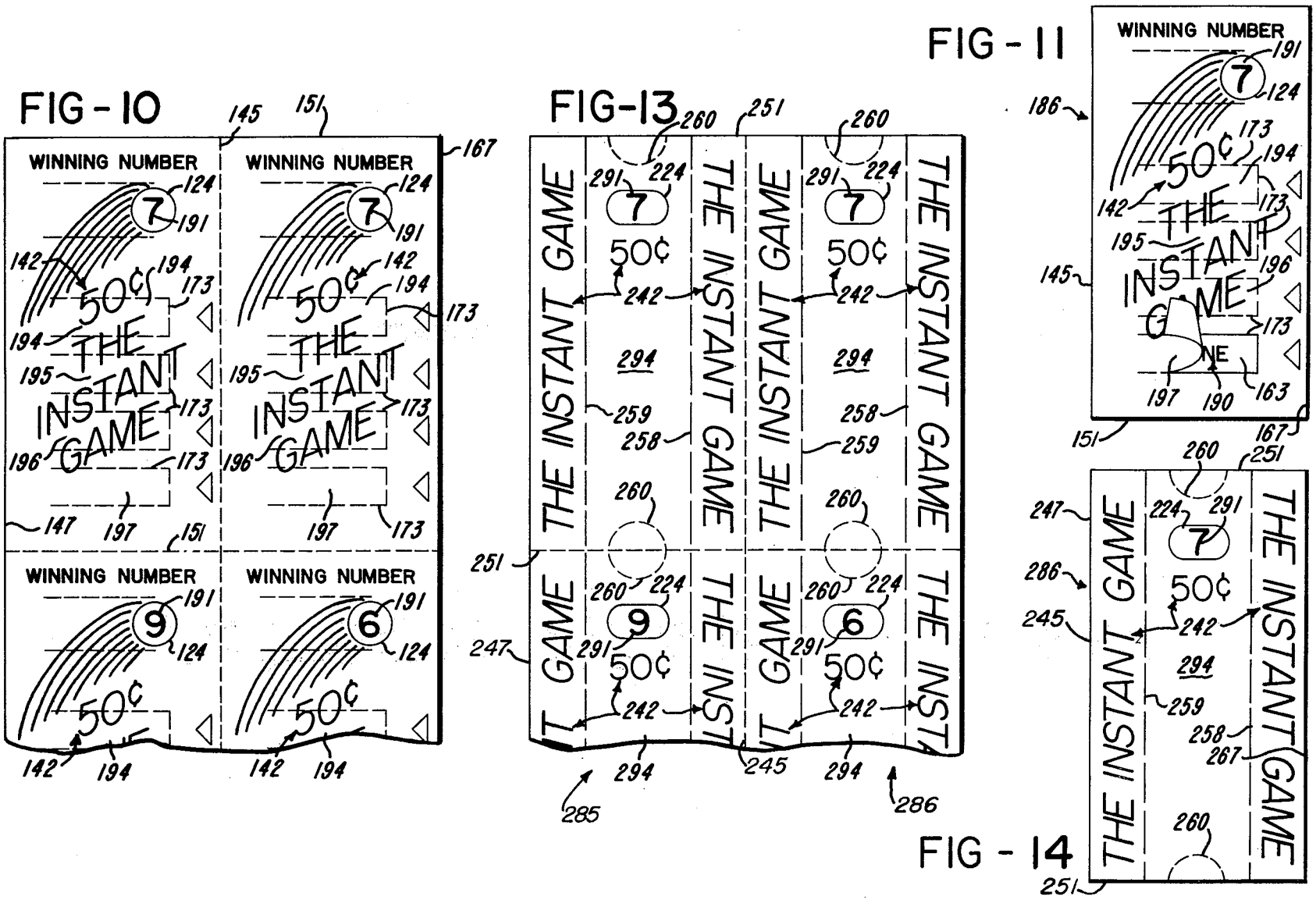
FIGS. 12–14 illustrate the various steps for producing a third continuous form by the process of FIGS. 1–3 and a lottery ticket obtained therefrom.

A second embodiment of the continuous form 30 is illustrated in FIGS. 9–11 and is identical in principle to that of the envelope form in FIGS. 4–8. Elements of the form of FIGS. 9–11 are indicated by numerals in the hundred series and correspond to similar elements in FIGS. 4–8.

The continuous form 130 is prepared by steps of a process like that of FIGS. 1 and 2 and is illustrated in FIG. 9, after application of original indicia 190 and 191. The web is separated into basic panels 143 and 146 by longitudinal foldline 147 and into independent blanks by transversely spaced weakened lines 151. As before, indicia 142 may be preprinted on the form at station 12 of FIG. 1, see FIG. 10, and line or sprocket holes 171 and 172 are included to facilitate progression of the form through the processing steps.

The form of FIGS. 9–11 includes independent transversely spaced blanks each defining two individual articles in parallel side-by-side relationship, each blank being bounded by a pair of longitudinally spaced, transverse tear lines 151, 151. The bottom ply of each ticket is defined by subpanels **185*a* and 186*a*, and the top ply of each ticket is defined by corresponding subpanels 185*b* and 186*b*. After the form has been printed at station 32, panels 185*b* and 186*b* are folded onto and disposed in direct overlying relationship with panels 185*a* and 186*a*** for generating an interconnected series of tickets.

The particular glue pattern of the second embodiment is illustrated in FIG. 9, wherein adhesive 111 completely surrounds the periphery of pocket area 163 of each panel, forming a seal between plies, thereby encasing the concealed indicia in a closed pocket area. Thus, when original indicia 190 is applied to region 163, see FIG. 9, and later concealed by cover panels **185*b* and 186*b* as in FIG. 10, the indicia 190 is contained in a completely sealed pocket 163**, making improper access and exposure impractical.

After application of the glue 111, the form is advanced through computer printing station 32 for adding the indicia 190 and 191. The web is then folded along foldline 147, as shown in FIG. 10, to cover panel 143, which indicia 191 being exposed through windows 124. The glue 111 is next activated, the excess marginal material is removed along lines 167 and 168 and the individual tickets are separated at lines 151, 162 and 145 for distribution.

A typical ticket 186 is illustrated in FIG. 11. Individual tear strips 194, 195, 196, and 197, defined by the U shaped scorelines 173 provide access to concealed indicia 190 contained on the upper surface of under ply 186*a*, which is in reality a portion of panel 143. To open the ticket, see FIG. 11, the holder simply bends along a bias provided by line 173, extending the tip of a strip, for example strip 197, and peels back to expose indicia 190.

Figure 12:
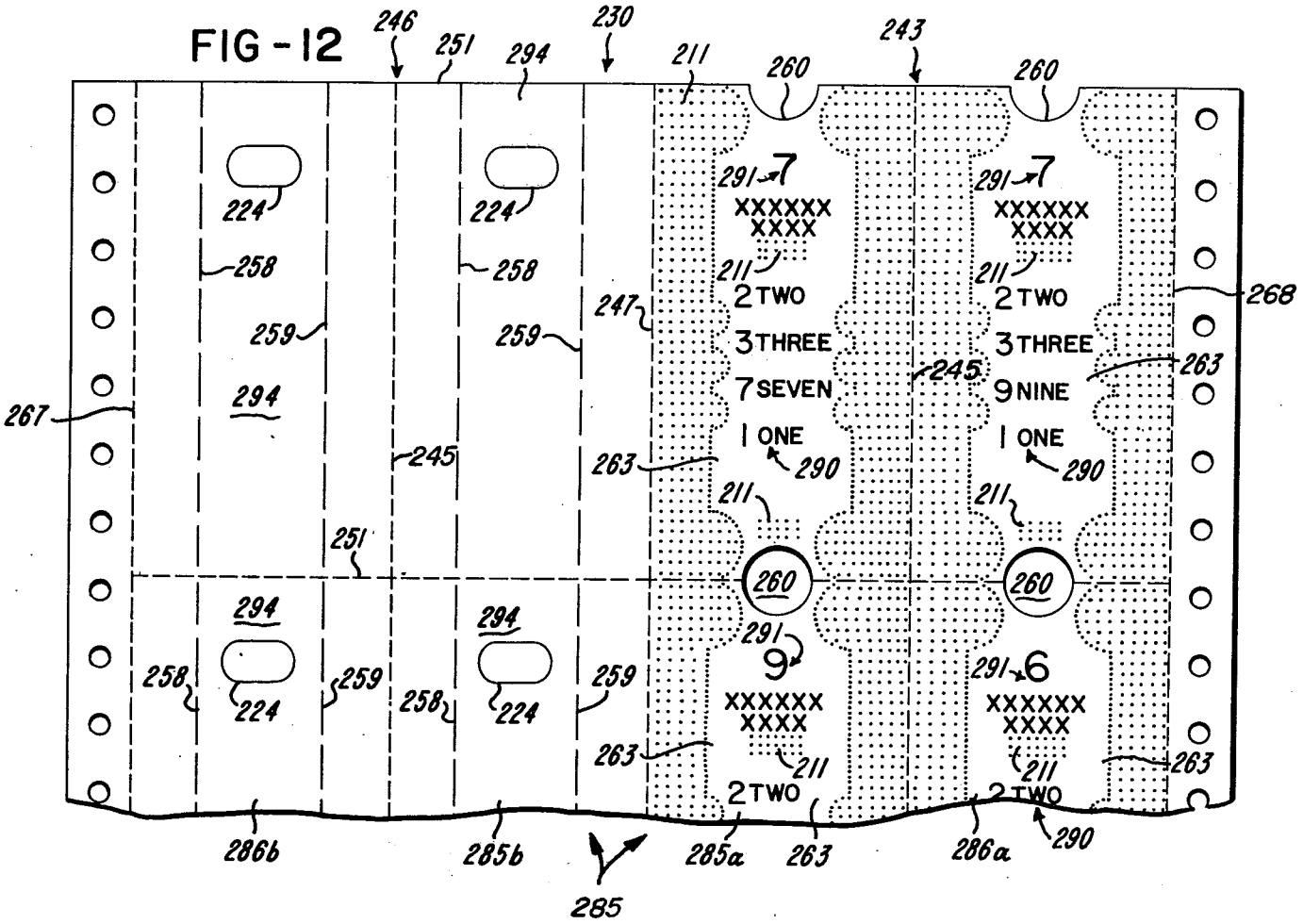

A third embodiment of the form of the present invention is included in FIGS. 12–14. This form is again identical to the earlier formats in principle and differs from earlier embodiments in that a continuous tear strip 294 has been added to the cover ply and the glue pattern does not completely surround the concealed indicia. To facilitate in understanding the similarities between forms, elements of the third embodiment have been indicated by numbers of the two hundred series, corresponding to like elements of previous embodiments, As in the second embodiment, the third embodiment includes a continuous form having a pair of side-by-side tickets defined by each independent blank.

The continuous form 230 is illustrated after application of concealed indicia 290 and 291 supplied to an adhesively uncoated region 263 of bottom ply 243. The underside of panel 246 is pre-printed with indicia 242, see FIG. 13. The continuous form is separated into two panels 243 and 246 bounded by longitudinal fold line 247, wherein each blank defines two side-by-side tickets 285 and 286, each having a top ply 285*b* and 286*b* and a bottom ply 285*a* and 286*a*.

The particular pattern of glue 211 of the third embodiment is illustrated in FIG. 12, and while substantially surrounding the periphery of each printable area 263 with adhesive for forming a seal between plies, the top and bottom regions of the ticket are uncoated with adhesive, permitting access between panels to facilitate in removal of tear strip 294. Windows 224 are included in tear strip regions, and expose indicia 291 when the form is folded along line 247, as illustrated in FIG. 13. Each tear strip 294 is defined by two continuous longitudinally extending spaced tear lines 258 and 259, thereby providing access to the concealed indicia 290 on the upper surface of under ply 243. Thumb or access notches 260 are die cut in a preliminary step of the process, and provide access to tear strip 294, whereby placement of a thumb in an access notch 260 permits the holder to grasp tear strip 294 and tear along lines 258 and 259 thereby exposing concealed pocket area 263 bearing originally applied indicia 290.

After application of glue 211, the form is advanced through computer printing station 32 for adding indicia 290 and 291. The form is then folded as shown in FIG. 13 to conceal panel 243, with indicia 291 exposed through windows 224. Glue 211 is activated, the marginal excess is removed along lines 267, 268 and the individual tickets are separated at lines 251 and 245. A typical ticket 286 is illustrated in FIG. 14.

A fourth embodiment of the invention is illustrated in FIGS. 15–18, wherein the window of the previous embodiments has been replaced by a cover panel of lesser width than the under ply, thereby exposing a portion of the under ply when disposed in overlying relationship therewith. Again, to facilitate in the understanding of the similarities between various embodiments, like elements are given reference numerals in the three hundred series corresponding to elements of earlier embodiments.

Figure 15:
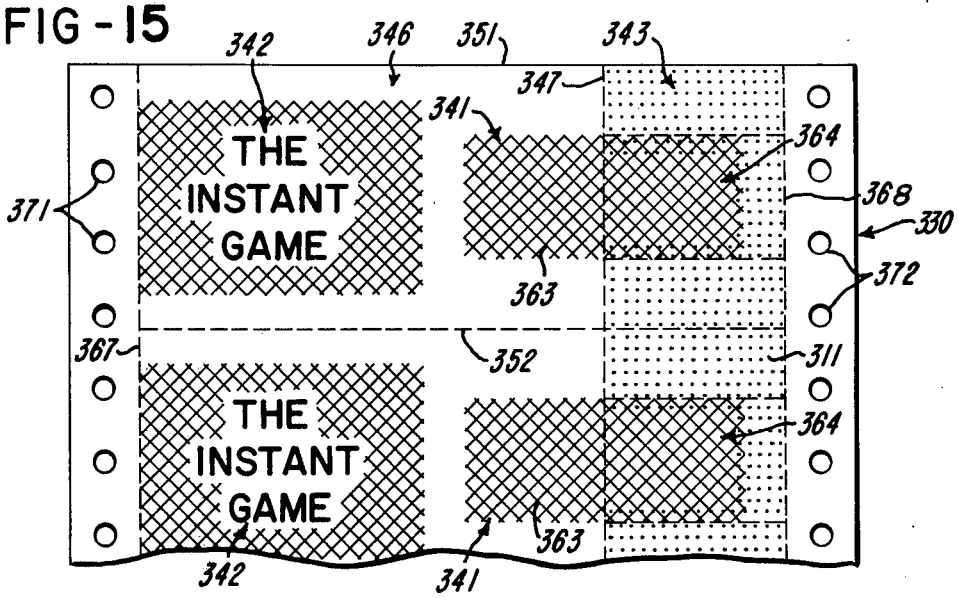
FIGS. 15–18 illustrate the various steps for producing a fourth continuous form by the process of FIGS. 1–3 and a lottery ticket obtained therefrom.

Form 330, prior to application of original indicia is illustrated in FIG. 15 and is separated into panels 343 and 346 by longitudinal foldline 347. Each blank, as defined by lines 351 defines a single article. The particular glue pattern is illustrated in FIG. 15, wherein glue 311 is contained entirely within panel 346 of the continuous form 330, bounded by line 347 and marginal edge line 368. Unlike in previous embodiments, it can be seen that the glue here is confined to the top or cover panel of the final article, see FIGS. 17 and 18. It should be understood where hot-melt glue, as herein defined, is utilized, glue only need be applied to either the cover panel or the under panel in any of the previous embodiments. Further, where a pressure-sensitive glue is utilized it would be necessary to provide a mirror image pattern of glue 311 on the under ply 343 of the present embodiment.

It will be noted that an opague substance 341 has been provided in region 363 of the under ply to a corresponding region 364 of the cover ply. This opaque substance may be preprinted as with indicia 342 at station 12 of FIG. 1 and further enhances the tamperproof qualities of the resulting ticket by preventing tranmission of light therethrough to expose the concealed indicia.

Figure 16:
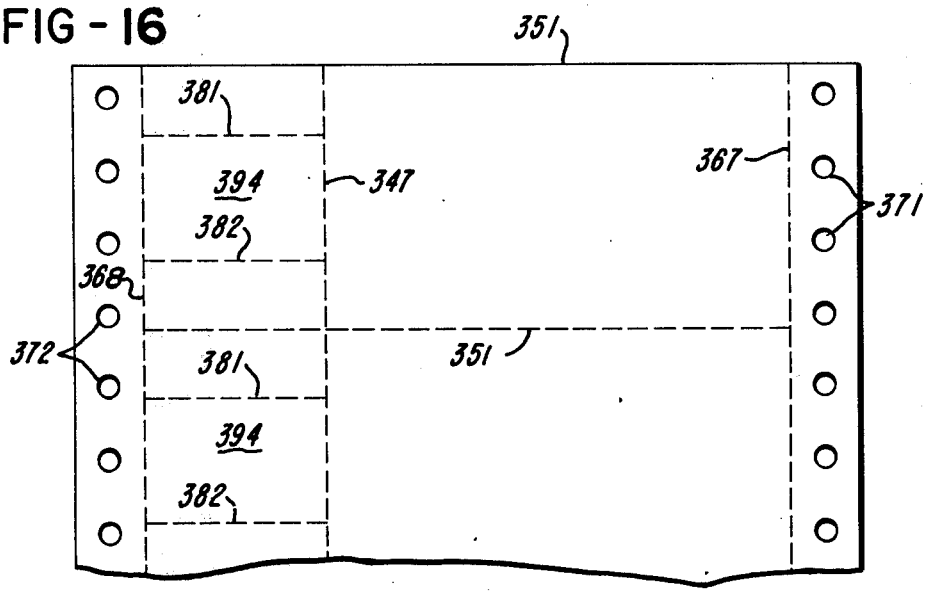

The reverse side of form 330 is illustrated in FIG. 16, and illustrates in detail the tear strip 394 provided by lines 381 and 382 which transversely span the width of panel 346, intersecting foldline 347 and marginal edge line 368.

Figure 17:
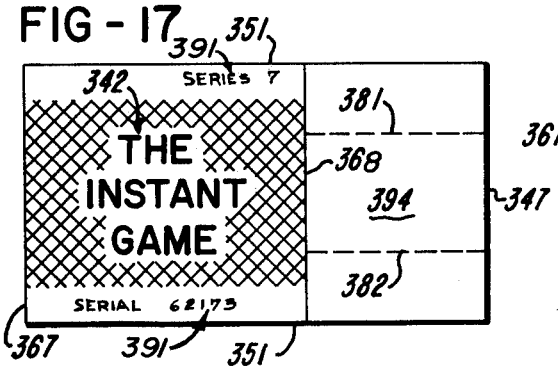

After application of original indicia 390 to region 363 of panel 343 and indicia 391 to panel 346 the excess marginal portions including line holes 271 and 272, are separated from the form along lines 368 and 367 and the form is folded along line 347 to generate a series of interconnected tickets, a typical ticket being illustrated in FIG. 17. It should be noted, in the present embodiment, the excess and marginal portions are removed prior to folding, necessitated by the difference in the physical characteristics of the under ply and cover ply.

Figure 18:
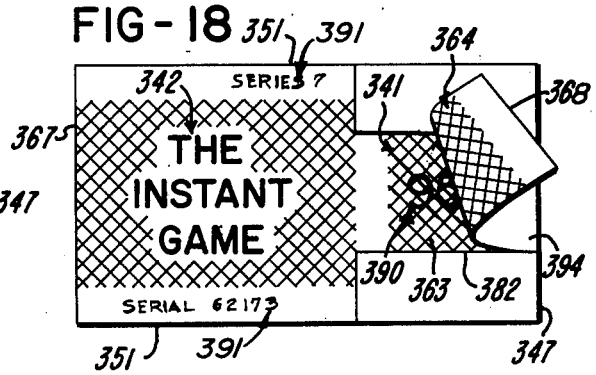

As illustrated in FIGS. 17 and 18, indicia 390 is concealed by cover panel 346 and is surrounded on the three margins by a marginal glue band 311, a hinge formed by line 347 providing a seal along the fourth margin. The original indicia may be exposed by lifting tear strip 394 at edge 368 of panel 343 and tearing along lines 381 and 382.

The embodiment illustrated in FIGS. 19–25 is identical in principle to earlier embodiments, differences drawn only to detail. Form 430 of FIGS. 19–25 differs from earlier embodiments in that a third panel 449 has been added. To facilitate in understanding the similarities between the various forms, like elements have been indicated with numbers of the four hundred series corresponding to elements of earlier embodiments.

Panel 449 has been added, thereby generating a final ticket of three-ply construction rather than the two-ply construction of earlier embodiments. Panel 449 is bounded by line weakened 431, which serves the same purpose as line 447, separating panels 443, 446 and 449 at continuous longitudinal foldlines. Glue 411 completely surrounds the printable area 463 of panel 443, with corresponding glue patterns in each of panels 446 and panels 449. Each blank section defines one ticket wherein the under ply, here center panel 443, is longitudinally off-set from the corresponding side panels 446 and 449 in such a manner that a portion of the under ply 443 will be exposed when the various side panels are disposed in corresponding registered relationship therewith. This is achieved by providing off-set transverse boundary lines 451a separating the various central panels from one another, with lines 451, 451 separating side panels of the form, as in previous embodiments, eliminating the necessity of a window but permitting panels of the same perimetric dimensions to be utilized, thus allowing longitudinal spacing of blanks along the length of the continuous web.

Indicia 442, see FIGS. 22 and 23, is applied at station 12 of FIG. 1 to the underside of panels 446 and 449. As in previous embodiments, line holes 471 and 472 are supplied to facilitate progression of the form through the various steps in the process and are removed along lines 468 and 467, see FIG. 23, prior to completion of the final article.

After application of glue 411, the blank receives original indicia 490 and 491 on an upper surface of panel 443. Then side panel 449, defining an intermediate ply, is disposed in direct, overlying relationship with panel 443 as illustrated in FIG. 21. Side panel 446 defining the cover ply, is next disposed in direct, overlying relationship with panel 449 as illustrated in FIG. 22 to generate a series of interconnected tickets bearing original, directly applied indicia concealed by plies 446 and 449. As can be seen, no glue is provided in regions 400 and 401 of panels 446 and 449, respectively. Thus, when panel 449 is disposed in direct, overlying relationship with panel 443, region 401 will not become attached thereto and will permit separation in final processing steps. Marginal excess portions, including line holes 471 and 472, are next removed and the tickets are separated along lines 451, 451a, 451 into individual tickets, an example of which is illustrated in FIG. 23.

Cover ply 446 includes a single tear strip 494 generated by U shaped tear line 473 as in earlier embodiments, and by bending the ticket along a bias provided by line 473, tear strip 494 may be removed, exposing tear strips 495, 496, 497 and 498 of intermediate cover ply 449. Tear strips 495, 496, 497 and 498 are also defined by a U shaped tear lines 474, and when removed as shown in FIG. 24, expose indicia 490.

A modification is illustrated in FIG. 25, wherein panel 449 has been omitted, thus providing a two-panel blank as in earlier embodiments. The resulting ticket is identical in appearance to the ticket of FIG. 23, however only tear strip 494 need be removed to expose panel 443 and indicia 490. Region 401 is provided on panel 446, corresponding to region 400.

In summary, I have provided a variety of continuous forms each defining a series of connected articles, such as envelopes, lottery tickets or like articles wherein original, directly applied indicia is applied to a concealed portion of the final article. Each of the articles includes a cover panel with means for permanently exposing a portion of the under ply which may or may not bear original, directly applied indicia. While the forms vary in detail, illustrating various features of the invention, all are generated from steps of the process of FIGS. 1, 2, and 3, with the addition or deletion of certain steps as required by the various configurations.

The final articles produced from each of the forms are obtained particularly by the process of FIG. 3, each form incorporating pattern gluing to generate a complete or substantially complete seal between the concealed portion of the under ply and the immediately covering ply, wherein access panels are provided inward of the seal to expose original indicia therecontained. While each of the embodiments incorporates various features of the invention, it should be understood that each of these embodiments could be combined in any fashion to produce still other articles varying in detail but identical in principle to those disclosed. Further, it should be understood that the method, continuous forms, and articles here described are merely illustrative and are not intended to restrict the spirit of the invention or limit the scope of the appended claims.

What is claimed is:

1. A method of producing a series of interconnected blanks suited for processing into individual envelopes, lottery tickets or like articles having an under ply containing original, directly applied indicia on one surface thereof and a cover ply disposed in substantial overlying relationship with said under ply, concealing selected portions of said indicia, comprising the steps of:

a. continuously advancing an endless web of material toward an accumulating station;

b. transversely subdividing said web into a series of interconnected blanks, the width of each of which is defined by at least two longitudinal, contiguous, coplanar panels which collectively define the cover ply and under ply panels of the article;

c. selectively applying an adhesive to a surface of one of the plys to be positioned adjacent at least two sides of the concealed portion thereby generally surrounding the concealed portion for positioning the indicia in a pocket area which is substantially completely and permanently sealed to the cover ply in a manner such that improper access to the pocket area is impractical;

d. accumulating said series of interconnected blanks for further processing, and thereafter;

e. continuously advancing said interconnected blanks toward an indicia applying station;

f. applying original indicia directly to an upper surface of the under ply panel; and g. continuously folding and activating the adhesive for substantially permanently bonding said cover ply panel in substantial overlying relationship with said under ply panel thereby positioning the concealed portions of the indicia in the pocket area, and completing a series of interconnected envelopes, lottery tickets or like articles each having indicia concealed inside a substantially completely and permanently sealed pocket area.

2. A method as called for in claim 1, wherein the adhesive comprises a hot melt-glue which is initially applied to the web while in an adherent, tacky, liquified state, after which it is transformed to a solid, non-tacky state prior to step *d* and wherein said folded panels are permanently bonded in step *g* by the application of heat to transform the adhesive from a solid, non-tacky state to a tacky, adherent heatliquified state.

3. A method as called for in claim 1, wherein the adhesive comprises a self-stick adhesive which is adherent only to another surface coated with like adhesive; wherein the adhesive is applied in step *c* to portions of an upper surface of each contiguous panel of the web;

and wherein said folded panels are permanently bonded in step *g* when the adhesive portions of said panels are disposed in direct contacting relationship.

4. A method as called for in claim 1, which comprises the additional step of separating the series of interconnected envelopes, lottery tickets, or like articles into individual items.

5. A method as called for in claim 1, wherein said cover ply and said under ply are of the same perimetric dimensions, wherein the cover ply includes a window for exposing a portion of the under ply when folded onto and disposed in direct, overlying relationship therewith.

6. A method as called for in claim 1, wherein said cover ply is of lesser width than said under ply, for exposing a portion thereof when folded onto and in direct overlying relationship therewith.

7. A method as called for in claim 1, wherein said cover ply and said under ply are of the same perimetric dimensions, and wherein said cover ply is longitudinally offset from said under ply for exposing a portion thereof when folded onto and disposed in direct overlying relationship therewith.

8. A method as called for in claim 1, wherein the width of each blank is defined by three longitudinal, contiguous, coplanar panels which define an under ply, and a cover ply of the final article, and an intermediate ply adapted to be disposed therebetween, and wherein said adhesive is applied to portions of the upper surface of at least two of said panels.

9. A method as called for in claim 8, wherein said cover ply, said intermediate ply, and said under ply are each of the same perimetric dimensions, and wherein said cover and intermediate plies are each correspondingly longitudinally offset from said under ply for exposing a portion thereof when folded into corresponding overlying relationship therewith.

10. The method of claim 1, wherein said adhesive completely surrounds the concealed portion.

11. The method of claim 1, wherein said adhesive is located on three sides of the concealed portion.

* * * * *